US007708620B2

(12) United States Patent
Kipp

(10) Patent No.: US 7,708,620 B2
(45) Date of Patent: May 4, 2010

(54) METHOD AND DEVICE FOR GENERATING DRY ICE PARTICLES

(76) Inventor: Jens Werner Kipp, Klashofsiedlung 3, Bielefeld (DE) 33659

( * ) Notice: Subject to any disclaimer, the term of this patent is extended or adjusted under 35 U.S.C. 154(b) by 444 days.

(21) Appl. No.: 11/571,622

(22) PCT Filed: Jan. 3, 2005

(86) PCT No.: PCT/EP2005/000031

§ 371 (c)(1),
(2), (4) Date: Jan. 4, 2007

(87) PCT Pub. No.: WO2006/005377

PCT Pub. Date: Jan. 19, 2006

(65) Prior Publication Data

US 2008/0287040 A1 Nov. 20, 2008

(30) Foreign Application Priority Data

Jul. 13, 2004 (DE) ..... 20 2004 011 090 U
Oct. 20, 2004 (DE) ..... 10 2004 051 005

(51) Int. Cl.
*B24B 1/00* (2006.01)

(52) U.S. Cl. ..... 451/38; 451/39; 451/40; 451/90; 451/102

(58) Field of Classification Search ..... 451/38, 451/39, 40, 90, 91, 102
See application file for complete search history.

(56) References Cited

U.S. PATENT DOCUMENTS

| | | | | |
|---|---|---|---|---|
| 4,253,610 | A * | 3/1981 | Larkin | 239/430 |
| 5,125,979 | A * | 6/1992 | Swain et al. | 134/7 |
| 5,779,523 | A * | 7/1998 | Mesher | 451/93 |
| 5,975,996 | A * | 11/1999 | Settles | 451/102 |
| 6,315,639 | B1 * | 11/2001 | Kipp | 451/38 |
| 7,143,967 | B2 * | 12/2006 | Heinrich et al. | 239/597 |
| 2002/0182987 | A1 * | 12/2002 | Shaw | 451/75 |

FOREIGN PATENT DOCUMENTS

| | | |
|---|---|---|
| EP | 0509132 A1 | 10/1992 |
| JP | 2002-143731 | 5/2002 |
| WO | 2004/033154 A1 | 4/2004 |

OTHER PUBLICATIONS

Swain, E.A., "Annular CO2 Snow Cleaning Nozzle," Xerox Disclosure Journal, Xerox Corporation, Stamford, Conn., vol. 20, No. 6, Nov./Dec. 1995, pp. 481-484, XP000555735.

* cited by examiner

*Primary Examiner*—Eileen P. Morgan
(74) *Attorney, Agent, or Firm*—Richard M. Goldberg

(57) ABSTRACT

A method for generating a jet of dry ice particles, in which liquid carbon dioxide is expanded in an expansion space (12) in order to form dry ice particles which are then introduced into a flow of a carrier gas, and the discharge of the dry ice particles from the expansion space (16) is throttled by a constriction (20, 26; 28; 30; 32; 36; 38).

9 Claims, 6 Drawing Sheets

METHOD AND DEVICE FOR GENERATING DRY ICE PARTICLES

BACKGROUND OF THE INVENTION

The invention relates to a method for generating a jet of dry ice particles, wherein liquid carbon dioxide is expanded in an expansion space in order to form the dry ice particles which are then introduced into a flow of a carrier gas, and to a device for carrying out this method.

Such a method and device have been disclosed in WO 2004/033154 A1. The device forms part of a blasting equipment which serves to remove firmly adhering incrustations from larger surfaces such as the internal surfaces of pipes or boilers in industrial plants. The liquid carbon dioxide is introduced from a supply line that is formed by a capillary, for example, into an expansion space having a larger cross-section, so that, by expansion, a portion of the carbon dioxide is evaporated while another portion of the carbon dioxide condenses to dry ice particles due to the evaporation chill. The expansion space opens, preferably laterally, into a blasting line through which a carrier gas such as compressed air or nitrogen is passed. Thanks to the drag of the carrier gas flowing past the mouth of the expansion space, the dry ice particles are, so to say, sucked out of the expansion space and are suspended in the flow of carrier gas. A nozzle, preferably a Laval nozzle, is provided at the end of the blasting line, so that the jet is accelerated to high speeds, preferably supersonic speeds.

In one embodiment described in this document, the expansion space is formed by a pipe section that has an internal thread. This internal thread is supposed to form disturbance edges at which a crust of dry ice shall be formed by the impinging dry ice particles. This is based on the theory that larger dry ice particles would be formed by crumbling of the crust. As an alternative to the internal thread, disturbance edges are mentioned, that are formed by inserts such as an impeller wheel or a worm in the interior of the expansion space. In this context, it has heretofore been assumed that the disturbance edges shall serve as targets for the dry ice to impinge on, but, on the other hand, shall not hamper the discharge of the dry ice particles and the gas from the expansion space, because, otherwise, the pressure in the expansion space would become too large and hence the expansion and evaporation of the liquid carbon dioxide would be compromised.

SUMMARY OF THE INVENTION

It is an object of the invention to further improve this known method and device in order to achieve a more efficient generation of dry ice particles and a high cleaning effect.

This object is achieved by the method according to the invention, wherein the discharge of the dry ice particles from the expansion space is throttled by a constriction of the cross-section.

It has been shown that, contrary to what was expected, the throttling of the discharge flow out of the expansion space does not compromise the creation of dry ice particles, but, on the contrary, promotes the same. Presumably, this is due to the fact that the throttling of the discharge flow promotes the growth of the dry ice particles through condensation, in particular since the throttling increases also the dwell time of the dry ice particles in the expansion space. Experiments in which the cleaning effect of the jet generated in this way has been evaluated, have shown that, with this measure, an increase in performance by 50 to 100% can be achieved. In addition to the creation of larger and harder dry ice particles, it has been found to be another advantageous effect of the invention that a more uniform jet profile is formed at the exit of the blasting nozzle, and all this with a non-changed or even reduced consumption of liquid carbon dioxide.

In the document mentioned above, it is also mentioned that the expansion space should have a certain minimum length. By the constriction according to the invention, this minimum length can be reduced without loss of performance, so that a more compact and habile construction of the device is made possible.

A device for carrying out the method according to the invention is characterized in that a constriction in cross-section is provided at the exit of the expansion space.

Useful details of the invention are indicated in the dependent claims.

Preferably, the constriction should amount to at least 20% of the cross-sectional area of the expansion space.

The constriction is preferably achieved by approximately streamlined structures around which the dry ice particles may well flow around and which do not present a substantial impact surface to the dry ice particles.

According to an embodiment of the invention, a squeeze body shaped as a cone, a sphere or a semi-sphere is provided on the central axis of the expansion space, this squeeze body having its rounded or tipped side pointing in the upstream direction. Then, the exit cross-section of the expansion space is formed by an annular gap between the wall of the expansion space and the squeeze body. In addition, axial bores may be provided in the squeeze body.

According to another embodiment, the constriction in cross-section is achieved by a tapered configuration of the exit end of the expansion space. These measures may also be combined by providing a squeeze body essentially in the tapered exit portion of the expansion space.

According to another embodiment, the supply line for the liquid carbon dioxide and the expansion space are arranged coaxially inside of the blasting line, so that the constricted exit of the expansion space is arranged essentially inside of the blasting line. In this case, it is convenient that the portion of the blasting line located between the exit of the expansion space and the blasting nozzle is widened to form a chamber. The squeeze body may then project into this chamber and into the blasting line, respectively.

BRIEF DESCRIPTION OF THE DRAWINGS

Embodiments of the invention will now be explained in detail in conjunction with the drawings, wherein.

DETAILED DESCRIPTION

Figure 1:
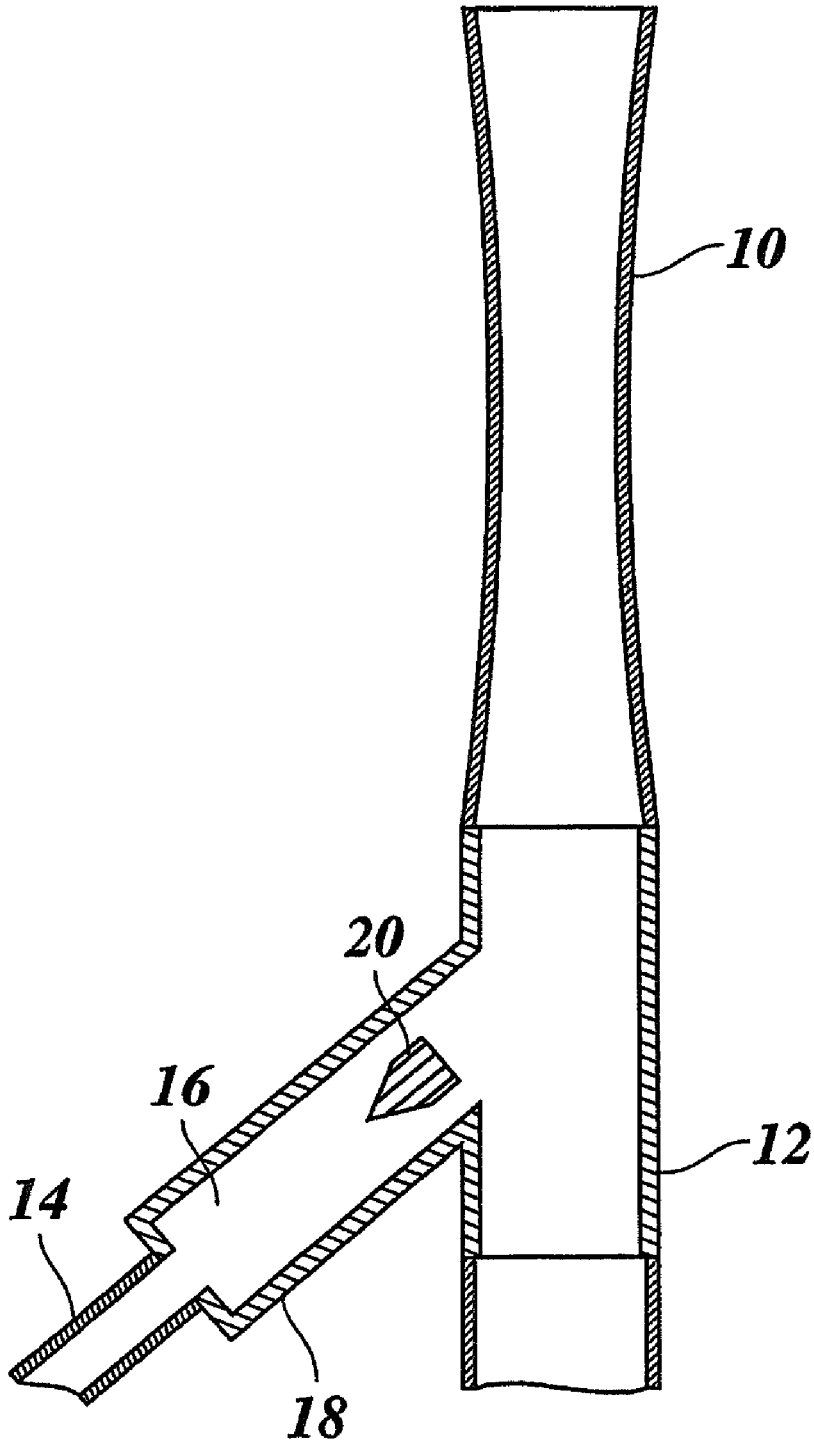
FIG. 1 is a longitudinal section of a device according to a first embodiment of the invention.

The device shown in FIG. 1 comprises a blasting nozzle 10, e.g. a convergent/divergent nozzle or a Laval nozzle, which is to create a jet of the carrier gas which has approximately sonic speed or supersonic speed and in which dry ice particles are suspended as a blasting medium. The blasting nozzle 10 is connected to a blasting line 12 which is again connected to a pressure source (not shown) and through which a carrier gas is passed, for example compressed air with a pressure in the order of magnitude of 1 MPa and a flow rate of, e.g., 1 to 10 $m^3$/min.

Via a supply line 14, liquid carbon dioxide is supplied from a high pressure tank or a cold tank that has not been shown. The supply line is for example formed as a capillary or is throttled by an adjustable baffle, so that the flow rate of liquid carbon dioxide will be in the order of magnitude of 0.1 to 0.4 kg per $m^3$ carrier gas (volume under atmospheric pressure), for example.

The supply line 14 opens into an expansion space 16 which has an enlarged cross-section and is formed by the interior of a pipe section 18 that merges obliquely into the blasting line 12. When the liquid carbon dioxide is expanded at entry into the expansion space 16, a part of the carbon dioxide is evaporated, and the evaporation chill created thereby causes another part of the carbon dioxide to condense to dry snow, i.e. to solid dry ice particles. These dry ice particles are entrained into the blasting line 12 by the gaseous carbon dioxide created simultaneously therewith or are sucked out of the expansion space 16 by the dynamic pressure of the carrier gas and are thus dispensed in the flow of carrier gas and are finally discharged with high speed from the blasting nozzle 10 onto a work piece to be cleaned. Preferably, the flow rate of liquid carbon dioxide and the flow rate of the carrier gas are adjustable.

In the downstream portion of the expansion space 16, i.e. at the location where the expansion space opens into the blasting line 12, a cone-shaped squeeze body 20 is arranged on the central axis of the pipe section 18, the squeeze body being oriented coaxially with the pipe section 18 and having its tip facing towards the mouth of the supply line 16 opening into the expansion space 16. The mixture of gaseous and solid carbon dioxide flowing out of the expansion space 16, possibly still mixed with a certain amount of liquid carbon dioxide, is squeezed by the squeeze body 20 and thus exits into the blasting line 12 only in a throttled manner, because a constriction is formed by the squeeze body 20 and the walls of the pipe section 18. Thanks to this, the dwell time of the dry ice particles in the expansion space 16 which is saturated with cold, gaseous carbon dioxide, is increased, so that the dry ice particles have time to grow by condensation. At the same time, the constriction creates a non-uniform flow profile with a flow speed that increases from the expansion space 16 towards the annular gap formed between the squeeze body 20 and the wall of the pipe section 18. Further, the constriction increases the density with which the dry ice particles are suspended in the gaseous medium. All this promotes the growth of very firm dry ice particles which will then show a high cleaning effect because of their size and hardness. At the same time, the streamlined shape of the conical squeeze body 20 prevents the dry ice particles, that have grown in size, from being crushed by impacting onto the squeeze body 20.

Figure 2:
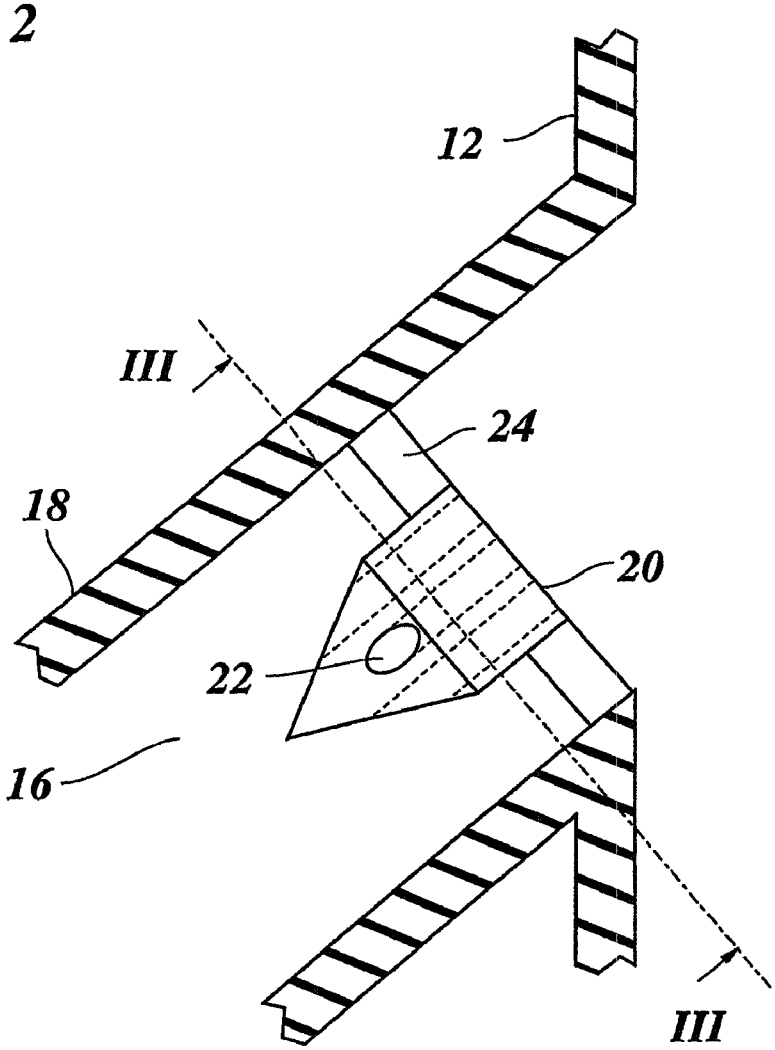
FIG. 2 shows a detail of FIG. 1 in an enlarged scale.
Figure 3:
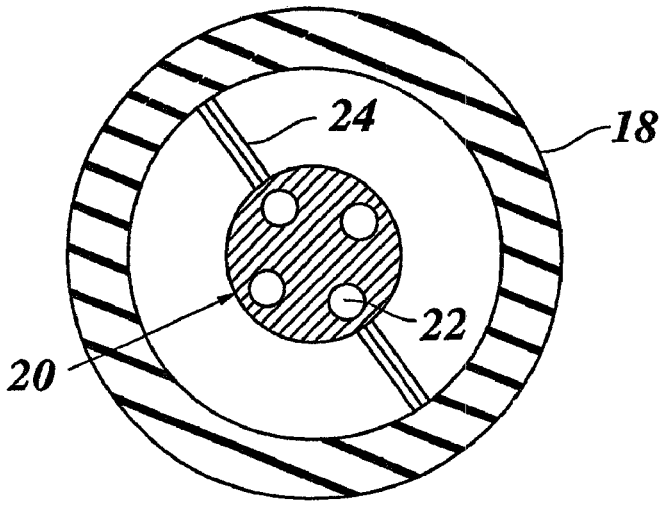
FIG. 3 is a section along the line III-III in FIG. 2.

In FIGS. 2 and 3, the squeeze body 20 has been shown on an enlarged scale. Axial bores 22 in the squeeze body 20 permit to optimally adjust the flow profile of the medium exiting from the expansion space 16. Radial webs 24 hold the squeeze body 20 centrally in the pipe section 18 and have such a shape that they do practically not present any impact surfaces for the dry ice particles.

Figure 4:
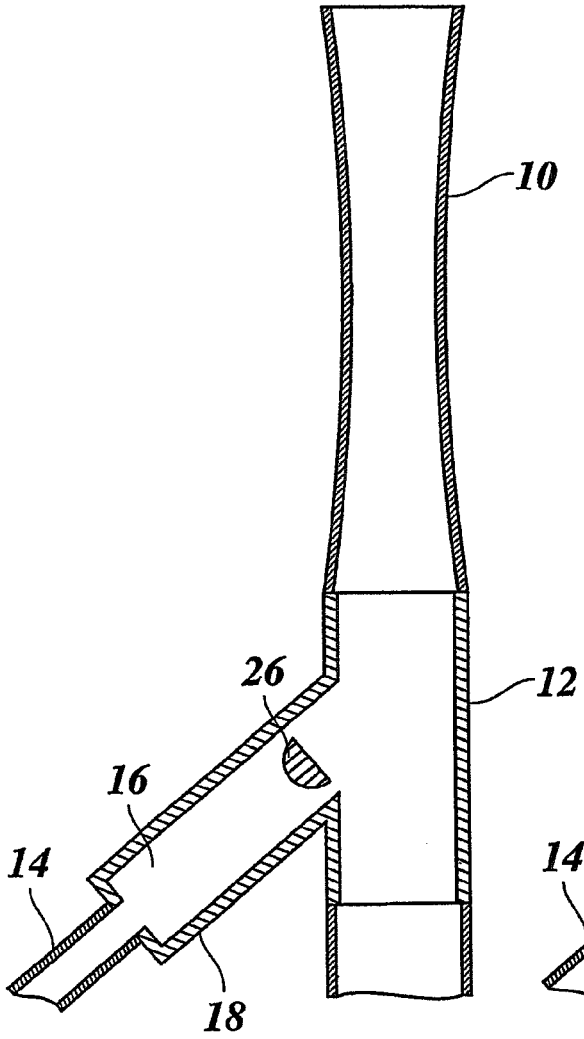
FIGS. 4 to 9 are axial sections through devices according to further embodiments of the invention.
Figure 5:
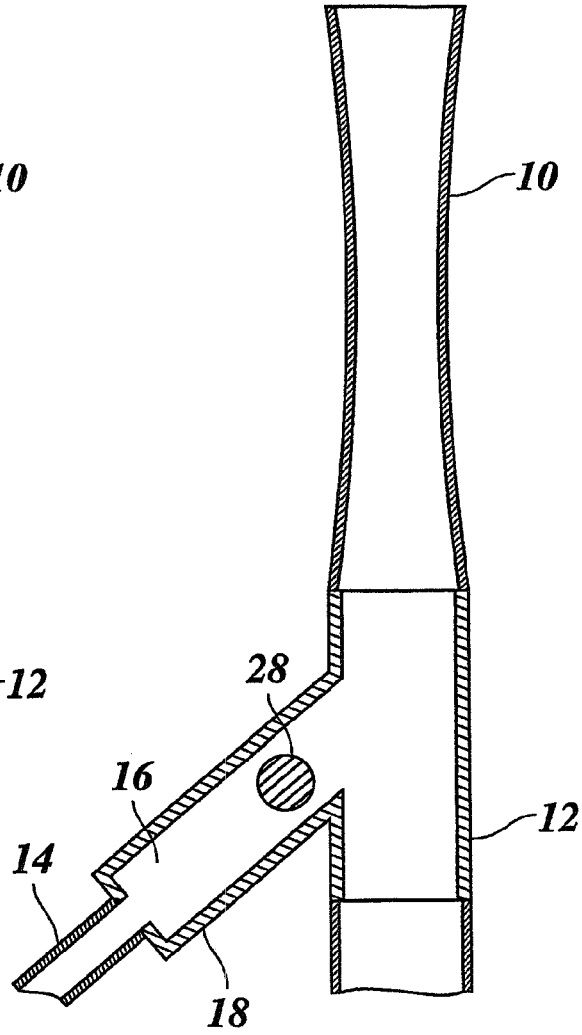
Figure 6:
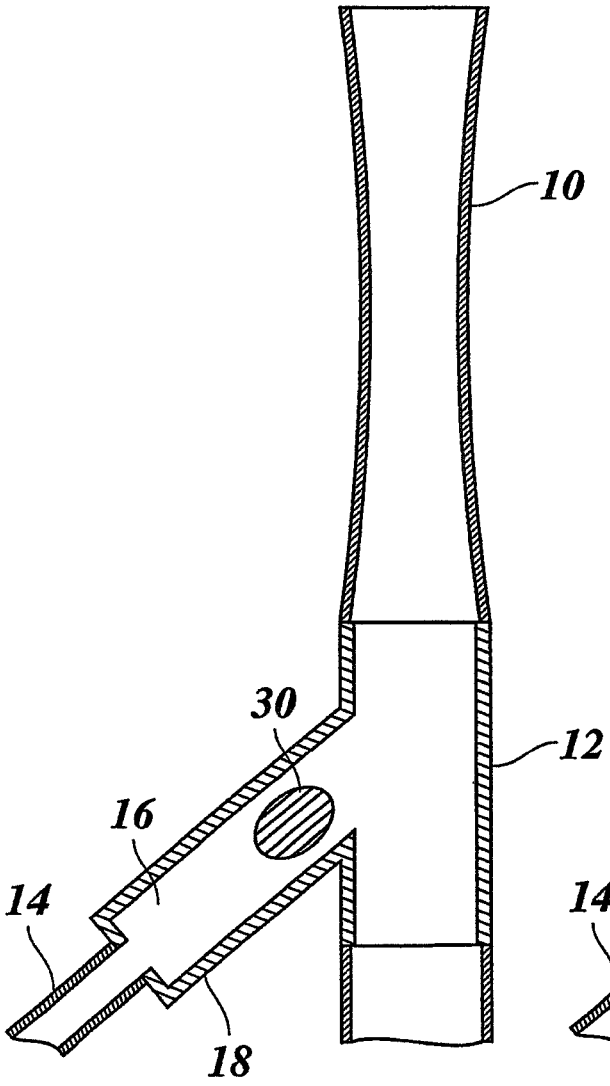
Figure 7:
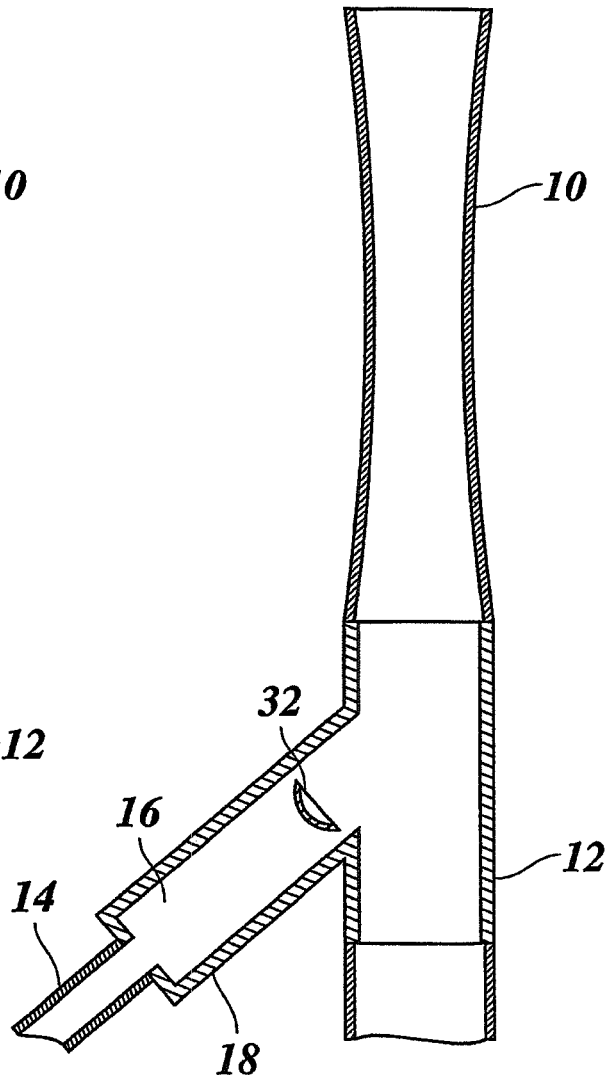

FIGS. 4 to 7 show modified embodiment examples of the device. These examples differ from the device according to FIG. 1 only in a modified shape of the squeeze body. In FIG. 4, a squeeze body 26 is formed as a semi-sphere a rounded side of which is oriented in upstream direction, i.e. towards the mouth of the supply line 14. In FIG. 5, a squeeze body 28 in the form of the sphere is provided. FIGS. 6 and 7 show squeeze bodies 30, 32 shaped as an ellipsoid and a spherical shield, respectively. These squeeze bodies 26, 28, 30 and 32 are fixed in the pipe section 18 similarly as the squeeze body 20 and may optionally also be provided with axial bores.

Figure 8:
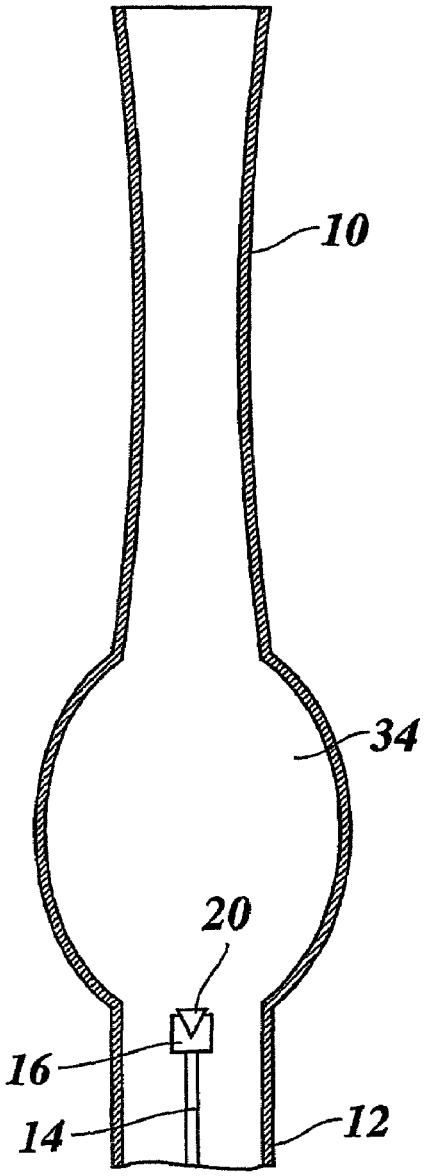

FIG. 8 shows a modified embodiment, wherein an enlarged ellipsoidal chamber 34 is formed between the blasting line 12 and the blasting nozzle 10. Here, the supply line 14 for liquid carbon dioxide extends coaxially in the blasting line 12 upstream of the chamber 34 and opens into the expansion space 16 which is formed at the upstream end of the chamber 34 and opens axially into this chamber. The exit of the expansion space 16 is constricted in cross-section by the conical squeeze body 20. In this case, the squeeze body projects slightly into the blasting line 12 and the chamber 34, respectively, and thus provides for a favorable diffusion of the dry ice particles in the enlarged chamber 34.

Figure 9:
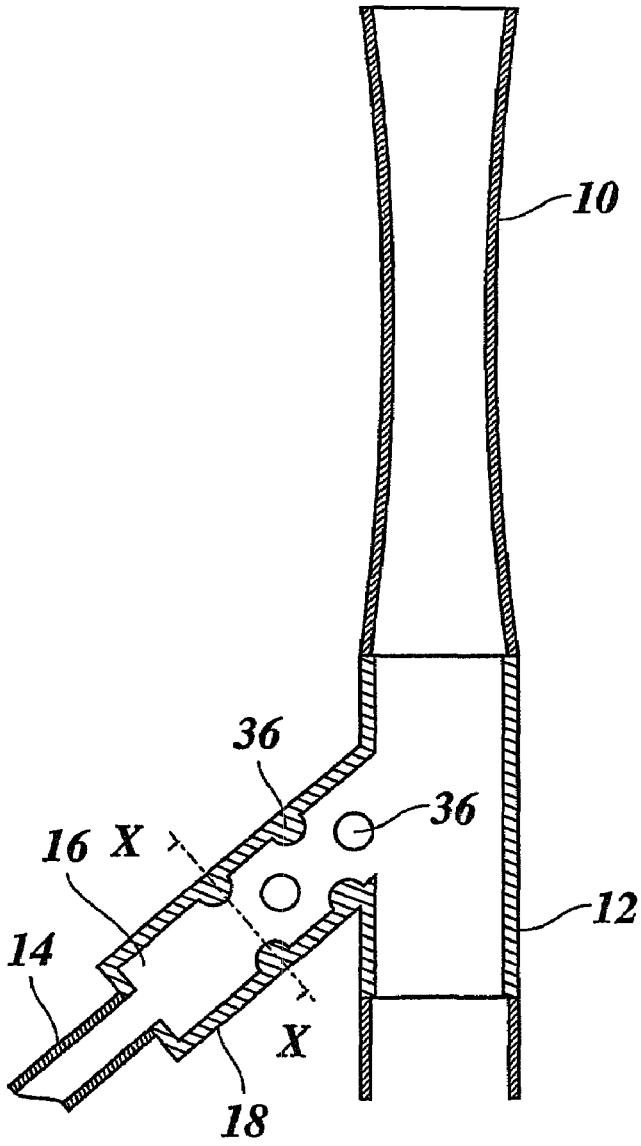
Figure 10:
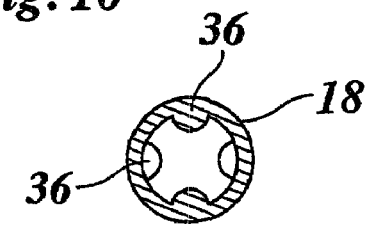
FIG. 10 is a section along the line X-X in FIG. 9.

FIGS. 9 and 10 show an embodiment of the device which has again a construction similar to that of the device shown in FIG. 1. Here, however, the constriction at the exit of the expansion chamber 16 is not formed by a centrally arranged squeeze body, but by boss-like squeeze bodies 36 that are distributed over the internal wall of the pipe section 18 in the downstream portion thereof.

Figure 11:
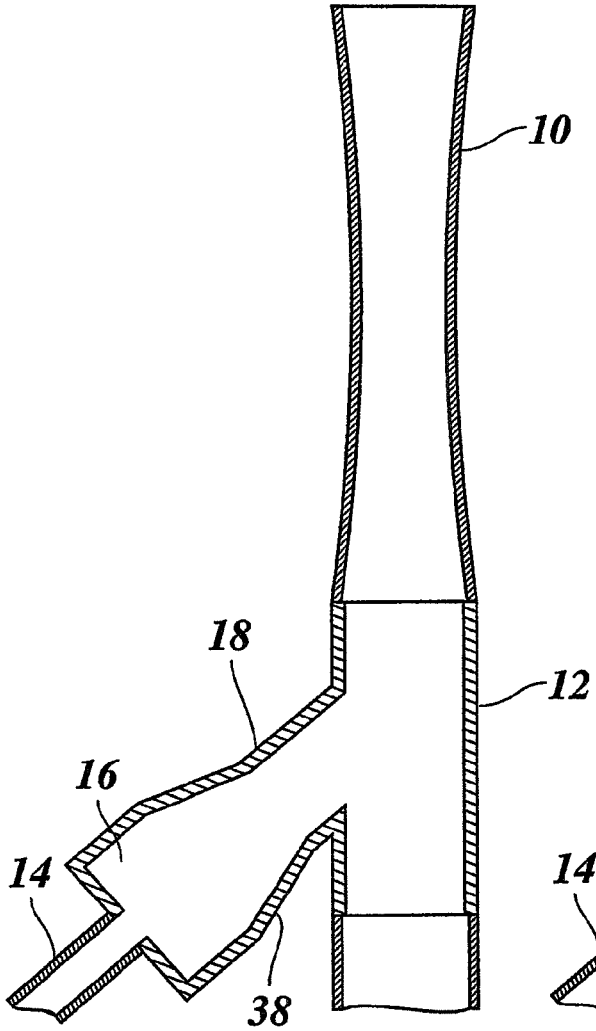
FIGS. 11 and 12 are axial sections of devices according to further embodiments.
Figure 12:
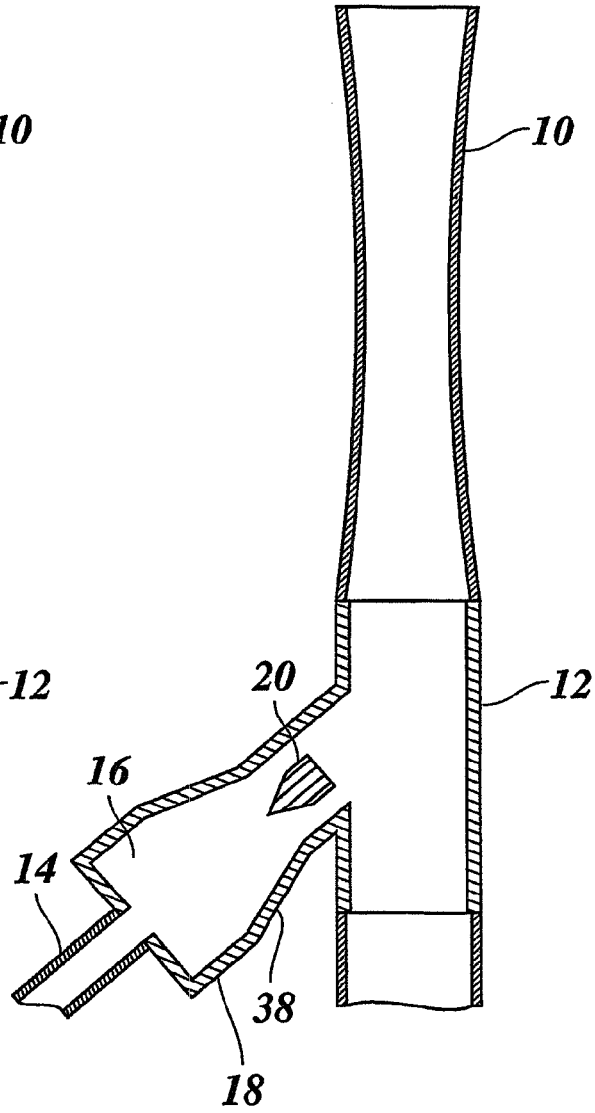

FIGS. 11 and 12 show embodiments in which the pipe section 18 has a larger cross-section at its end facing the supply line 14, with a conically tapered portion 38 adjoining thereto, which portion forms the exit of the expansion space 16 and at the same time the constriction of this exit. In the embodiment shown in FIG. 12, an additional squeeze body 20 is provided downstream of the conically tapered portion 38. Especially in compact devices in which the internal diameter of the blasting line 12 is smaller than approximately 15 mm, the length of the cylindrical expansion space 16 should not be too small in order for the expansion space to have a sufficient volume. Moreover, the diameter of the expansion space 16 is preferably larger than the diameter of the blasting line 12.

In the examples shown, the constriction in cross-section at the exit of the expansion space amounts typically to between 20 and 50% of the cross-sectional area inside of the expansion space 16. The exact amount of the constriction depends on the respective process parameters, in particular the pressure and the flow rate of the carrier gas, the flow rate of liquid carbon dioxide, the temperature of the liquid carbon dioxide and the like. In general, a constriction in the order of magnitude of 40% is convenient. The diameter of the blasting line 12 may vary, for example, between 8 and 32 mm.

What is claimed is:

1. A method for generating a jet of dry ice particles, comprising the steps of:

expanding liquid carbon dioxide in an expansion space having a cross-sectional area in order to form dry ice particles, throttling discharge of the dry ice particles from the expansion space by a constriction which reduces the cross-sectional area of the expansion space and which is formed by a squeeze body that is arranged centrally and coaxially in the exit of the expansion space, introducing the throttled dry ice particles into a flow of a carrier gas.

2. A device for creating a jet of dry ice particles, comprising:

a blasting nozzle, a blasting line for supplying a carrier gas to the blasting nozzle, a supply line for liquid carbon dioxide, which supply line opens into the blasting line via an expansion space having a cross-sectional area, wherein the liquid carbon dioxide is expanded in the expansion space in order to form dry ice particles, and a constriction at an exit of the expansion space and which reduces the cross-sectional area of the expansion space, said constriction formed by a squeeze body that is arranged centrally and coaxially in the exit of the expansion space, wherein the dry ice particles are throttled from the expansion space past the constriction and into a flow of the carrier gas.

3. The device according to claim 2, wherein the constriction amounts to more than 20% of an internal cross-sectional area of the expansion space.

4. The device according to claim 3, wherein the constriction amounts to more than 40% of an internal cross-sectional area of the expansion space.

5. The device according to claim 2, wherein the squeeze body is shaped as one of the following:

a cone, a semi-sphere, a sphere, an ellipsoid and a bulged shield.

6. The device according to claim 2, wherein the squeeze body is one of acute and rounded on a side facing towards the expansion space.

7. The device according to claim 2, wherein the squeeze body is blunt on a side facing away from the expansion space.

8. The device according to claim 2, wherein:

the supply line and the expansion space are arranged coaxially in the blasting line, and the blasting line is enlarged to form a chamber in a portion between the exit of the expansion space and the blasting nozzle.

9. The device according to claim 2, wherein:

the expansion space is formed by an interior of a pipe section, and the constriction is formed by a conically tapered portion of the pipe section.

* * * * *